US005724851A

United States Patent [19]

Rivard

[11] Patent Number: 5,724,851

[45] Date of Patent: Mar. 10, 1998

[54] METHOD AND APPARATUS FOR FORMING A LEAF SPRING EYE

[75] Inventor: Michael Rivard, Coatsworth, Canada

[73] Assignee: Eaton Corporation, Cleveland, Ohio

[21] Appl. No.: 641,455

[22] Filed: Apr. 30, 1996

[51] Int. Cl.[6] ..... B21D 19/12

[52] U.S. Cl. ..... 72/379.2; 72/294; 72/381; 72/370; 72/71; 140/104

[58] Field of Search ..... 72/294, 342.4, 72/404, 71, 381, 379.2, 367, 370; 140/104

[56] References Cited

U.S. PATENT DOCUMENTS

| | | | |
|---|---|---|---|
| 1,215,332 | 2/1917 | Berg | 72/294 |
| 1,339,443 | 5/1920 | Evans | 72/404 |
| 3,453,855 | 7/1969 | Morita | 72/342.4 |
| 3,967,487 | 7/1976 | Stout | 72/305 |
| 5,129,671 | 7/1992 | Walton | 280/718 |

FOREIGN PATENT DOCUMENTS

| | | | |
|---|---|---|---|
| 583624 | 12/1944 | United Kingdom | 140/104 |
| 772186 | 8/1954 | United Kingdom | 140/104 |

OTHER PUBLICATIONS

Oswald A. Ludwig, "METALWORK", pp. 290 and 291, 1947.

*Primary Examiner*—David Jones
*Attorney, Agent, or Firm*—A. E. Chrow

[57] ABSTRACT

Apparatus (100) and method are provided for forming an eye at the end of a heated leaf spring blank (2). Apparatus (100) includes a forming plate (16) operative to move angularly downwardly against a cantilevered portion (10) of blank (2) and roll it about a retractable rotary eye pin (5) to form the eye. Apparatus (100) includes neutralizing the force created by forming plate (16) against blank (2) during the rolling operation and further preferably includes a scarf blade (14) operative to move angularly to scarf or shape the end of portion (10) prior to the rolling operation.

4 Claims, 4 Drawing Sheets

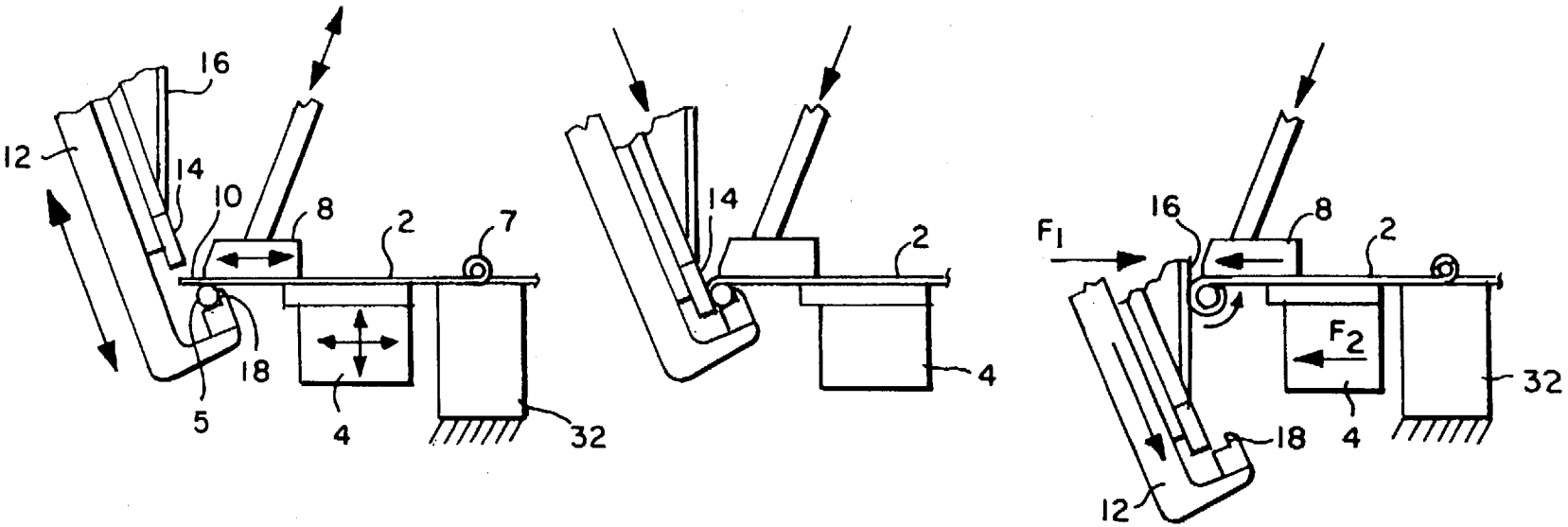
FIG. 1A
FIG. 1B
FIG. 1C
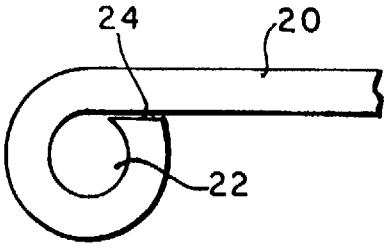
FIG. 2
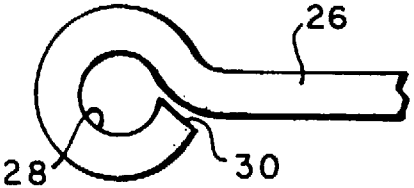
FIG. 3

62
5
4
60
56
54
58
34
32

METHOD AND APPARATUS FOR FORMING A LEAF SPRING EYE

INTRODUCTION

This invention relates generally to method and apparatus for forming an eye at the end of a vehicular leaf spring blank and more particularly to method and apparatus employing angular downward motion to both scarf the end of a heated leaf spring blank and then roll a predetermined length of the blank about a rotary eye pin to form the eye.

BACKGROUND OF THE INVENTION

Eyes have long been incorporated at one or both ends of a vehicular leaf spring to provide a means of support between the frame and axle of the vehicle.

Generally the eyes are adapted to receive bushings (more commonly elastomeric bushings) that in turn are adapted to be secured to the frame by means of a threaded pin or the like to provide pivotal support between the axle and the frame of which one example can be found in U.S. Pat. No. 5,129,671, assigned to the assignee of the present invention and the disclosure of which is included herein by reference.

Little has been reported in the development of machines to form an eye at the end of leaf springs since the early days of hand forging of heated leaf spring blanks. However, one example of such an automatic machine is disclosed in U.S. Pat. No. 3,967,487, the disclosure of which is included herein by reference. The apparatus disclosed however requires the complex positioning of a goose neck (49), movement of a scarf blank (22) to scarf the end of a heated leaf spring blank (19) followed by initial bending by a scroll die (73), followed by insertion of an eye pin (101), and then forming the eye by opposed motion of a scroll die surface (111) and scroll die 73.

The present invention provides a simpler and more economical method and apparatus for forming an eye at the end of a heated leaf spring blank by eliminating the goose neck die and the pair of opposed scroll dies and replaces them with a scarfing process that does not require a goose neck die and utilizes a singular forming plate that is operative to roll a cantilevered portion of the heated blank about an already positioned rotary eye pin and thereby eliminate the need for costly scroll dies involving arcuate surfaces.

SUMMARY OF THE INVENTION

Accordingly, it is an object of this invention to provide a method and apparatus for forming an eye at the end of a vehicular leaf spring.

It is another object of this invention to provide apparatus operative to form an eye at the end of a vehicular leaf spring blank without the need for costly dies hereto after used for such purposes in the past.

BRIEF DESCRIPTION OF THE DRAWINGS

FIG. 1A–1C are partial schematic diagrams illustrating the sequential movement of apparatus elements utilized in the invention;

FIG. 2 is a partial side elevation view of one embodiment of a leaf spring eye;

FIG. 3 is a partial side elevation view of another embodiment of a leaf spring eye;

SUMMARY OF SOME PREFERRED EMBODIMENTS

Figure 4:
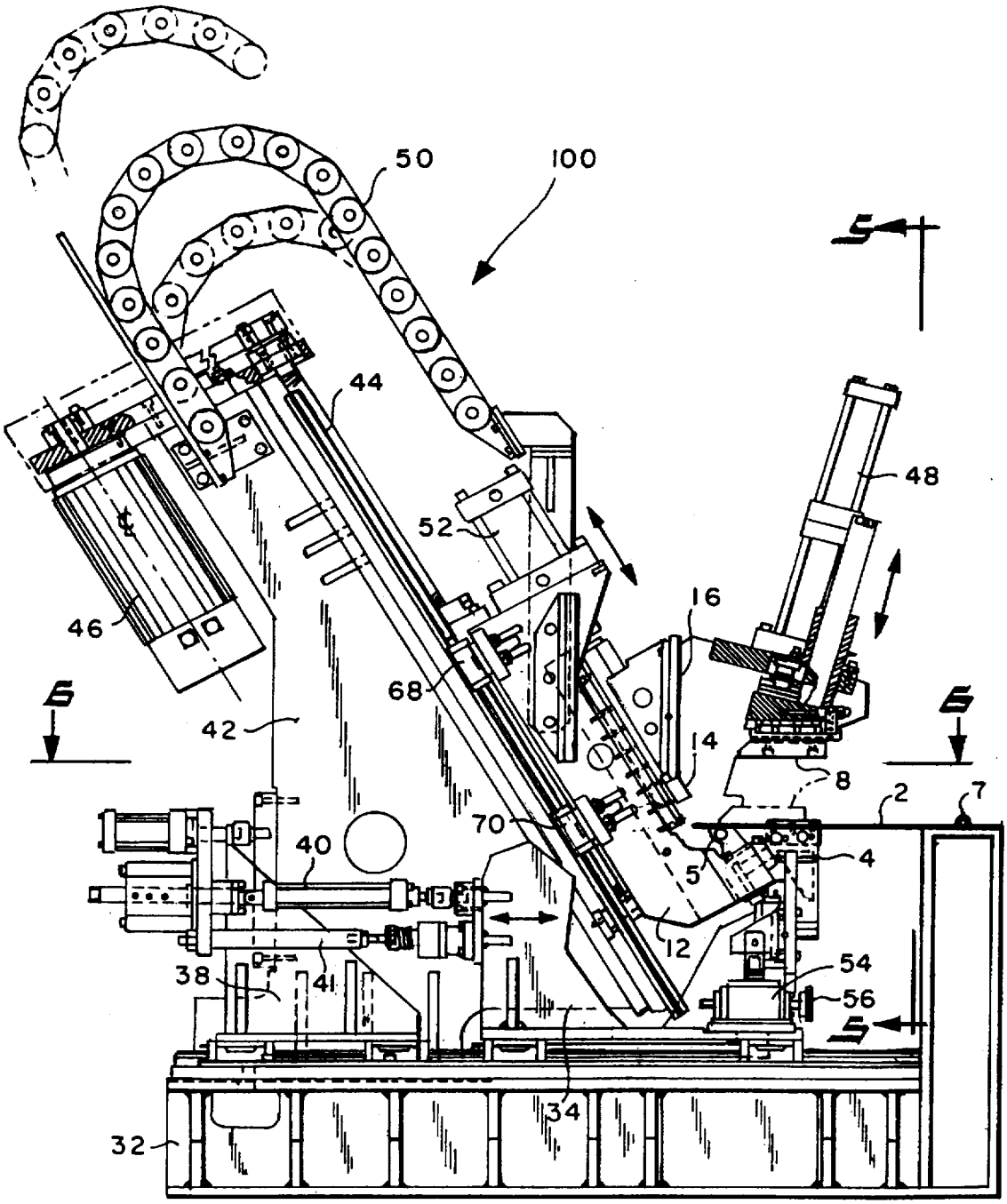
FIG. 4 is a side elevation view of a preferred embodiment of apparatus 100 of the invention.
Figure 5:
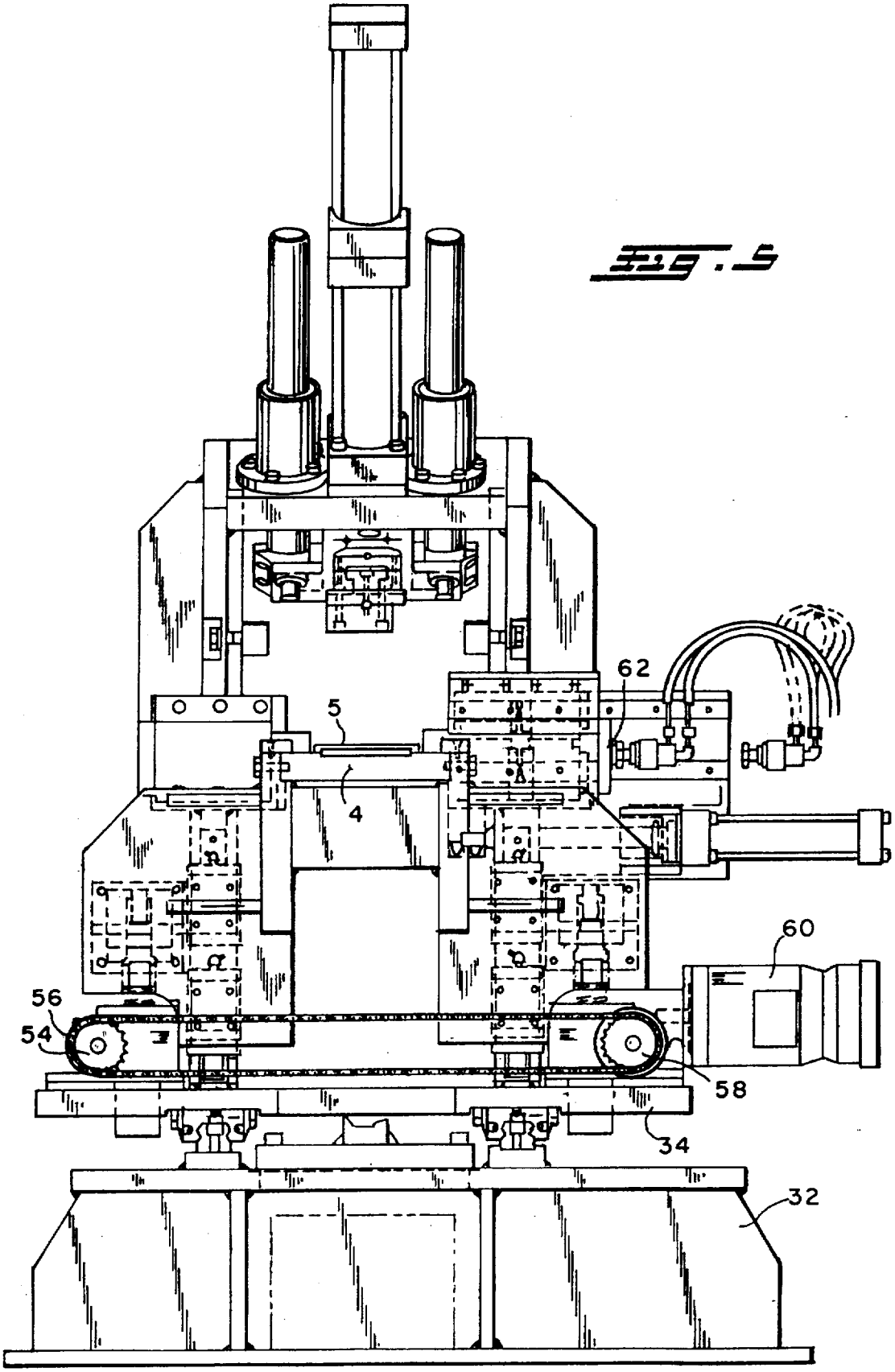
FIG. 5 is a view of apparatus 100 taken along view line 5—5 in FIG. 4.
Figure 6:
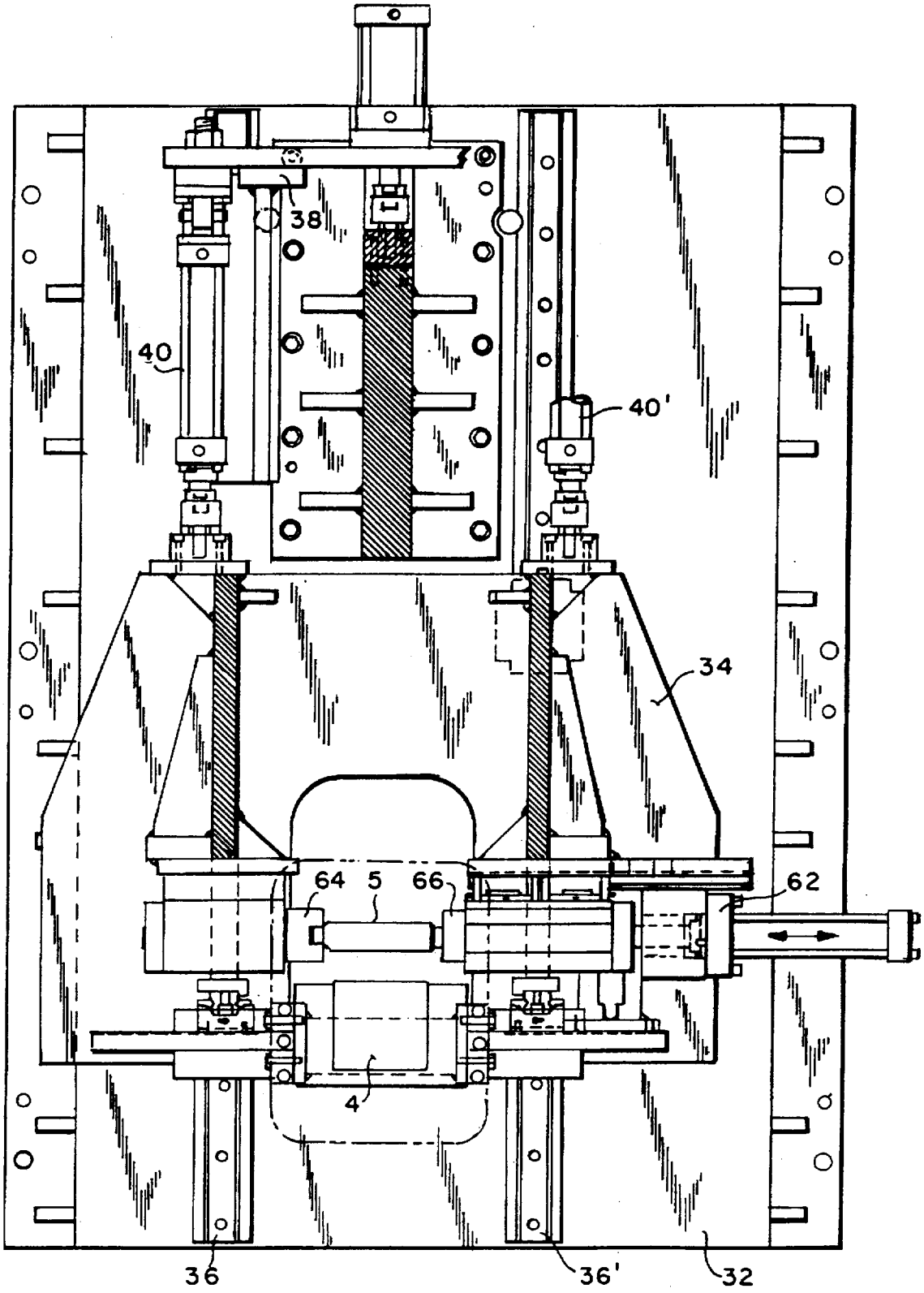
FIG. 6 is a view of apparatus 100 taken along view line 6—6 in FIG. 4.

The principles involved in the method of the present invention are illustrated in FIGS. 1A–1C in which the element numerals are also used in FIGS. 4–6 of the apparatus drawings for easier reference.

In FIG. 1A a heated leaf spring blank 2 is located upon and releasably secured to a first stationary support surface 32 by clamping means such as clamp 7. Leaf spring blank 2 is made from a resilient steel alloy well known to those skilled in the art that is suitable for leaf spring suspension systems and is heated to a working temperature that is characteristically in the order of about 1300°–1500° F.

Leaf spring blank 2 is also supported by a rotary eye pin 5 and a second support surface 4 that are respectively mounted for movement in unison with forming clamp mechanism 8. Forming clamp mechanism 8 is able to move upwardly and downwardly as well as horizontally in opposite directions as shown by the arrows in FIG. 1A.

Support surface 4 and rotary eye pin 5 are able to move horizontally and support surface 4 can also move upwardly and downwardly as well.

A portion 10 of leaf spring blank 2 is cantilevered away from eye pin 5 and is of a length predetermined to allow a scarf cut at the cantilevered free-end of leaf spring blank 2.

When initially held in a working position, rotary eye pin 5 is also supported by an arcuate support section 18 of frame 12. Frame 12 is movable angularly upwardly and downwardly in opposite directions as shown by the arrows in FIG. 1A. Frame 12 carries a scarf blade 14 and a forming plate 16. Scarf blade 14 and forming plate 16 are preferably movable with respect to frame 12.

In the sequence shown in FIGS. 1A and 1B, scarf blade 14 has moved angularly downwardly to engage and scarf the end of leaf spring blank 2 which in effect has shaped or formed the end of blank 2 so that it conforms to the underside of blank 2 after the forming operation.

In the sequence between FIGS. 1B and 1C, frame 12 has continued to move angularly downwardly as shown by the arrow enabling forming plate 16 to engage the side of cantilevered portion 10 facing away from eye pin 5 and then roll the cantilevered portion 10 of blank 2 about eye pin 5 as shown by the arrow.

While foraging plate 16 rolls cantilevered portion 10 about eye pin 10, it moves in a direction down and towards the viewers right in FIG. 1C exerting a force $F_1$ on eye pin 5. It is for this reason that forming clamp mechanism 8, support surface 4 and rotary eye pin 5 are urged towards the viewer's left with Force $F_2$ to provide full contact between forming plate 16 and that portion of blank 2 rolled about eye pin 5 as shown by the arrows in FIG. 1C.

It is to be noted that arcuate support surface 18 of frame 12 is not required in the forming operation between FIGS. 1B and 1C as it functions primarily to provide support for eye pin 5 during the angular downward engagement with scarf blank 14 to protect roller bearings and the like that are employed to journal eye pin 5 for rotation.

Although the scarfing operation is preferably included in the present invention, it is not required to be for, in some cases, it may be desired to roll the cantilevered portion of blank 2 about the eye pin without having scarfed the end of the blank.

FIGS. 2 and 3 illustrate two (2) different kinds of leaf spring eyes that can be formed by the method of the present invention. In FIG. 2, the end of leaf spring blank 20 has been rolled about the rotary eye pin of the apparatus of the invention to form eye 22 and its end has been scarfed to conform with the underside of blank 20 such as referenced by numeral 24. In this case the center of eye 22 is below the underside of blank 20.

In FIG. 3, an eye 28 has been formed in a leaf spring blank 26 by the method of the present invention with its end scarfed as referenced by numeral 30 but in this case the center of eye 28 is in substantial alignment with the neutral bending axis of blank 26 (not referenced).

Thus, various configurations can be made at the eye location either by raising or lowering support surface 4, relative to location of rotational axis of eye pin 5 and/or applying a force against plate 2 adjacent the outer perimeter of eye pin 5.

A preferred embodiment of apparatus operative to provide the method of the invention is referenced by numeral 100 in FIGS. 4–6.

In FIG. 4 apparatus 100 includes a base 32 upon the top of which are mounted slide rails 36 and 36'(the later is shown on FIG. 6).

A first frame 34 is slidably mounted in rails 36 and 36' for movement in opposite directions as shown by the arrows in FIG. 4.

A support surface 4 is mounted on frame 34 for movement therewith in opposite directions as shown by the arrows in FIG. 4. Support surface 4 is preferably positionable upwardly and downwardly preferably by means of an electric motor 60 and gear boxes 54 and 58 that are interconnected by chain 56 as best shown in FIG. 5.

As earlier described, a heated leaf spring blank 2 rests upon surface 4 and is held in contact with eye pin 5 by forming clamp mechanism 8 that is movable upwardly and downwardly preferably by means of an hydraulic cylinder 48, as shown by the dashed lines in FIG. 4.

All of rotary eye pin 5 forming clamp mechanism 8 (including cylinder 48) and support surface 4) are mounted on frame 34 so that they move in unison in opposite directions therewith as shown by the arrows in FIG. 4.

The rotary mounting of eye pin 5 is best seen in FIGS. 5 and 6 where the opposite ends of pin 5 are journaled for rotation by journal housings 64 and 66 respectively that in turn are mounted on frame 34 as earlier described.

Rotary eye pin 5 is also insertable and retractable so that it can be first positioned and then retracted after the eye has been formed. The retraction of eye pin 5 is preferably accomplished by having journal housing 66 slidingly mounted on frame 34 and movable in opposite directions as shown by the arrows in FIG. 6 preferably by means such as hydraulic cylinder 62 shown in FIGS. 5 and 6.

A second frame 42 (shown in FIG. 4) is fixedly secured to base 32 and is adapted to carry a third frame 12 that is angularly movable in opposite directions as shown by the arrows. Frame 12 includes support surface 18 (referenced in FIG. 1A and 1C but not shown in FIG. 4) and carries scarf blade 14 and forming plate 16 described earlier with respect to shown in FIG. 1.

Frame 12 is angularly movable preferably by means of being secured to a pair of spaced-apart ball nut tracks 68 and 70 that in turn are threadingly engaged with a rotary ball nut screw 44 that is rotated preferably by means of an electric motor 46.

Hydraulic cylinder 52 is secured to frame 12 as the preferred means for moving scarf blade 14 and forming plate 16 in opposite directions along frame 12.

It is to be understood that, although it is preferable to move both forming plate 16 and scarf blade 14 in unison by means of a singular power source such as hydraulic cylinder 52, they may be moved by separate power sources or both may be fixedly secured to frame 12 and positioned such that the angular movement of frame 12 alone enables either or both the scarfing and rolling operation to occur.

Also shown in FIG. 1 is a flexible track 50 that is operative to carry flexible hydraulic hoses and the like to convey fluid power between hydraulic motor 46 to cylinder 52.

Apparatus 100 is provided with means for urging frame 34 in an opposite direction to the direction (towards the viewer's right in FIG. 42 imposed upon eye pin 5 when the cantilevered portion 10 of leaf spring blank 2 is engaged by forming plate 16 as it is moved angularly downwardly so that it is able to apply a force imposed upon frame 34 by forming plate 16 as previously described with respect to Force $F_1$ in FIG. 1C.

The means for urging frame 34 towards the viewer's left in FIG. 4 is preferably provided by one or more hydraulic cylinders such as cylinders 40 and 40' that are respectively fixedly secured to base 32 by means of a frame 38 or the like and are operable to urge frame 34 (including support surface 4, forming clamp mechanism 8, rotary eye pin 5) towards the viewer's left to counteract the movement of frame 34 towards the viewer's right as forming plate 16 engages and rolls cantilevered portion 10 of blank 2 about eye pin 5 for a predetermined circumferential length as previously described with respect to Force $F_2$ in FIG. 1C.

Apparatus 100 also preferably includes one or more bumpers such as the spring loaded bumper 41 shown in FIG. 4 that, like hydraulic cylinders 40 and 40', have one end secured to stationary frame 38 and an opposite end to movable flame 34. Such bumpers are operative to minimize shock and linear oscillation during operation of apparatus 100.

Although it has been found that frame 12 (and scarf blade 14 and forming plate 16) are operative to move angularly upwardly and downwardly at a preferred included angle of from about 30° to vertical, other angles may be employed that enable scarf blade 14 to move angularly downwardly to scarf (dress or shape) the end of cantilevered portion 10 of leaf spring blank 2 in the manner desired and also enable forming plate 16 to move angularly downwardly to engage and roll cantilevered portion 10 about eye pin 5 while providing a force counteracting the force created on the eye pin by the forming plate during the rolling operation.

It is also to be understood that the present invention includes embodiments that enable the simultaneous or sequential formation of eyes at opposite ends of heated leaf spring blanks.

What is claimed is:

1. A method of forming an eye at an end of an elongate leaf spring blank having a longitudinal axis, said method including the steps of:

heating the blank to a predetermined temperature;

holding the heated blank in a working position with a cantilevered portion extending for a predetermined length from a rotary eye pin having a central rotational axis disposed in transverse relationship to the longitudinal axis of the blank;

engaging and rolling the cantilevered portion about the rotary eye pin for a predetermined circumferential length with a forming plate and thereby rotating the eye pin in response thereto while urging the eye pin in a direction towards the forming plate; and removing the eye pin from the eye.

2. The method of claim 1 including the step of scarfing the end of the blank with a scarf blade to conform the end with the bottom surface thereof prior to forming the eye.

3. The method of claim 2 wherein the scarf blade is operative to move angularly downwardly during the scarfing operation.

4. The method claim 1 wherein the forming plate is operative to move angularly downwardly during the process of forming the eye.

* * * * *